US005858132A

United States Patent [19]

Bell et al.

[11] Patent Number: 5,858,132

[45] **Date of Patent: *Jan. 12, 1999**

[54] ALLOYS CONTAINING INSOLUBLE PHASES AND METHOD OF MANUFACTURING THEREOF

[75] Inventors: Malcolm Charles Evert Bell; James Alexander Evert Bell, both of Oakville; Carlos Manuel Diaz, Mississauga; Thijs Eerkes, Oakville; Thomas Francis Stephenson, Toronto; Scott Thomas Campbell, Oakville; John Francis Brennan, Hamilton; Anthony Edward Moline Warner, Burlington, all of Canada

[73] Assignee: Inco Limited, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 766,430

[22] Filed: Dec. 12, 1996

Related U.S. Application Data

[60] Division of Ser. No. 538,061, Oct. 2, 1995, Pat. No. 5,765,623, which is a continuation-in-part of Ser. No. 358,861, Dec. 19, 1994, abandoned.

[51] Int. Cl.[6] ..... C22C 18/00; C22C 30/00

[52] U.S. Cl. ..... 148/441; 148/442; 420/514; 420/515; 420/580

[58] Field of Search ..... 148/441, 442; 420/590, 520, 514, 515, 522, 580

[56] References Cited

U.S. PATENT DOCUMENTS 3,676,115 7/1972 Hare et al. ..... 148/441

4,650,528 3/1987 Masumoto et al. ..... 148/441

FOREIGN PATENT DOCUMENTS 51-79633 1/1975 Japan .

63-203739 8/1988 Japan .

OTHER PUBLICATIONS

Raynor et al. "Ternary Alloys Formed by Aluminum, Transitional Metals and Divalent Metals*," Acta Metallurgical, vol. 1, pp.629–648. Nov. 1953.

*Primary Examiner*—Sikyin Ip

*Attorney, Agent, or Firm*—Blake T. Biederman; Edward A. Steen

[57] ABSTRACT

The invention provides a new method for casting alloys containing a finely divided phase. A bath of the molten metal having a melting point is provided. A finely divided solid metal having a melting point greater than the melting point of molten metal is introduced into the molten metal. The finely divided metal is reacted with the molten metal to form a solid phase within the molten metal. The molten bath is then mixed to distribute the solid phase within the molten metal. The molten alloy is then cast into a solid object containing the solid phase. The solid phase is insoluble in the matrix and has a size related to the initial size of the finely divided solid. The alloy of the invention advantageously consists essentially of, by weight percent, about 3 to 40 aluminum, about 0.8 to 25 nickel, about 0 to 12 copper and balance zinc and incidental impurities. The alloy has a zinc-containing matrix with nickel-containing aluminides distributed throughout the matrix.

7 Claims, 4 Drawing Sheets

ALLOYS CONTAINING INSOLUBLE PHASES AND METHOD OF MANUFACTURING THEREOF

This application is a division of application U.S. Ser. No. 08/538,061 filed Oct. 2, 1995 now U.S. Pat. No. 5,765,623, U.S. Ser. No. 08/538,061 was a continuation-in-part of U.S. Ser. No. 08/358,861, filed Dec. 19, 1994, now abandoned.

FIELD OF INVENTION

This invention relates to a method for manufacturing alloys containing insoluble metal phases. In particular, this invention relates to zinc alloys castable by hot chamber die casting techniques.

BACKGROUND OF THE INVENTION

Several alloy systems rely upon intermetallic precipitates for strengthening of mechanical properties. Intermetallics are especially useful for strengthening alloys at elevated temperatures. Typically, intermetallics are initially formed during solidification and cooling of an alloy. Homogenization and precipitation heat treatments are then used to control the size and distribution of the intermetallic precipitates. When the intermetallic precipitates are insoluble in the matrix, the size and distribution of the precipitates are extremely difficult to control.

As a consequence of relatively low melting temperatures, the strength of zinc and zinc-base alloys drops significantly with relatively small increases in temperature. For example, creep strength as well as tensile and yield strengths at 100° C. are typically reduced to between 65 to 75% of the room temperature strengths (ASM Metals Handbook, 10th Edition, Volume 2, p. 529). Primary creep resistance is generally improved by reducing the volume of primary phase (near eutectic compositions) and by alloying with elements such as copper. Of the commercially available zinc alloys, ZA-8 (UNS Z35636 8–8.8 Al, 0.8–1.3 Cu, 0.015–0.030 Mg, 0.004 max. Cd, 0.06 max. Fe, 0.005 max. Pb, 0.003 max. Sn and balance Zn) has the highest primary creep resistance (in the Zn—Al binary, the eutectic composition is at 6% Al). This effect has been noted for zinc-aluminum alloys containing high volume fractions (30 vol %) of ceramic particles where a near order of magnitude difference in creep rate has been observed for ZA-8 alloy. (Tang et al, "Creep Testing of Pressure Die Cast ZA-8/$TiB_2$, Composites," *Advances in Science, Technology and Applications of Zn—Al Alloys,* edited by Villaseñor et al, 1994.)

Improvements in creep resistance of zinc alloys has been attained by processing techniques that reduce the size of primary dendrites or by addition of a ceramic dispersion phase. Dendrite size has been reduced by increasing the rate of solidification or by mixing the alloy in the semi-solid state (rheocasting). Rheocasting of semi-solid metals was developed in the 1970s by M. Flemings and R. Mehrabian. Examples of rheocasting are illustrated in U.S. Pat. Nos. 3,902,544 and 3,936,298. Rheocasting involves agitation of partially solidified metals to break up dendrites and form a solid-liquid mush. This solid-liquid mush is thixotropic in Theological behavior which allows casting of high solid volume fractions by injection molding and die casting. The above developers of rheocasting, as well as others, have also proposed incorporating ceramic particles into thixotropic semi-solid metals (Mehrabian et al, "Preparation and Casting of Metal-Particulate Non-Metal Composites", *Met. Trans. A,* Vol. 5, (1974) pp. 1899–1905). A disadvantage of this technique is that the metal/ceramic system may be chemically unstable. Ceramic particles may react with the metal matrix to degrade the reinforcing phase and form undesirable brittle phases at the particle/matrix interface. A further disadvantage of ceramic addition is that the choice of a suitable reinforcement is also subject to mixing problems associated with density differences or wetting phenomena. Particles such as certain borides or carbides may also be cost prohibitive in relation to the cost of the matrix metal.

The morphologies of materials cast by the above rheocasting processes are typically characterized by primary dendrites with diameters between 100 and 400 microns for Zn—10Cu—2Sn, 304 stainless steel and Sn—Pb alloys. Finer particle sizes on the order of 35 to 70 $\mu$m were reported for ZA-27 alloy (UNS Z35841 25.0–28.0 Al, 2.0–2.5 Cu, 0.010–0.020 Mg, 0.004 max. Cd, 0.06 max. Fe, 0.005 max. Pb, 0.003 max. Sn and balance Zn) by Lehuy, Masounave and Blain ("Rheological behavior and microstructure of stir-casting zinc-aluminum alloys", *J. Mat. Sci.,* 20 (1985), pp. 105–113). According to Lehuy et al, clustering occurred for volume fractions of solids that exceeded 35 percent and particle size distribution tended to decrease with increasing melt temperatures.

It is an object of the invention to provide a method to control the size and distribution of insoluble metal phases.

It is a further object of the invention to provide a method for producing zinc-base alloys containing insoluble metal phases via a semi-solid route or "mush casting".

It is a further object of the invention to provide magnesium-base and zinc-base alloys with improved creep strength at elevated temperatures.

It is a further object of the invention to provide a method for producing stable magnesium-base and zinc-base alloys to facilitate extended holding and solidification times.

SUMMARY OF THE INVENTION

The invention provides a new method for casting alloys containing a finely divided phase. A bath of the molten metal having a melting point is provided. A finely divided solid metal having a melting point greater than the melting point of molten metal is introduced into the molten metal. The finely divided metal is reacted with the molten metal to form a solid phase within the molten metal. The molten bath is then mixed to distribute the solid phase within the molten metal. The molten alloy is then cast into a solid object containing the solid phase. The solid phase is insoluble in the matrix and has a size related to the initial size of the finely divided solid. The alloy of the invention advantageously consists essentially of, by weight percent, about 3 to 40 aluminum, about 0.8 to 25 nickel, about 0 to 12 copper and balance zinc and incidental impurities. The alloy has a zinc-containing matrix with nickel-containing aluminides distributed throughout the matrix.

DESCRIPTION OF PREFERRED EMBODIMENT

Figure 1:
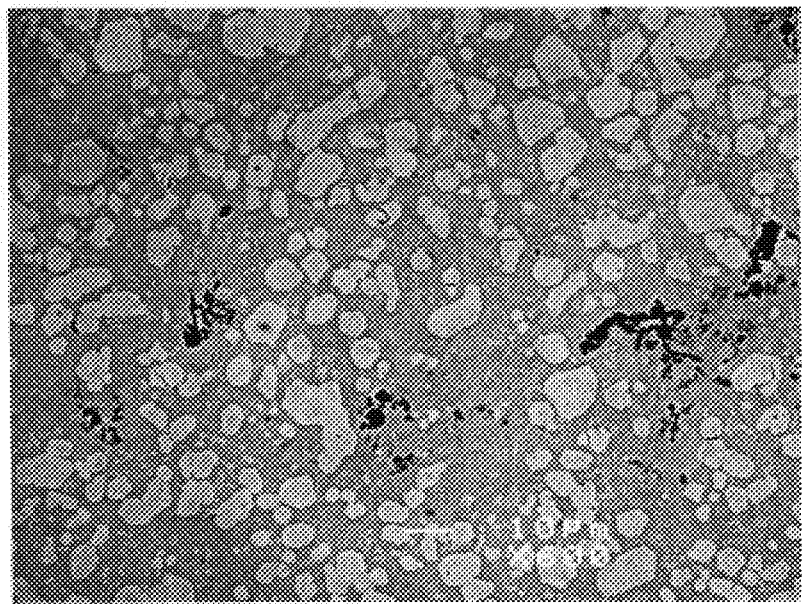
FIG. 1 is a photomicrograph (at a magnification of approximately 600×) of Zn—5Ni alloy mush cast by adding fine nickel powder and mixing the mush at 500° C. for 30 seconds.

It has been discovered that when a finely divided solid metal is added to molten alloys having a melting temperature less than the solid metal, the solid metal and molten alloy may react to form a new insoluble phase. For purposes of this specification, insoluble phases are defined as phases incapable of diffusing into a solid matrix at elevated temperatures by conventional heat treating methods within 24 hours. The insoluble phase forms a stable mush within the molten alloy provided that the amount of solid metal is sufficient to over-saturate the melt. Generally, final mechanical properties (tensile strength, creep strength) of metal alloys produced by such mush casting techniques improve with finer particle sizes and increasing volume fractions of the insoluble phase.

The method of the invention provides a unique method of casting alloys containing a stable insoluble finely divided phase. First, a bath of molten metal is provided. A finely divided solid is introduced into the molten metal. The finely divided solid, having a melting temperature greater than the melting point of the molten metal, does not melt in the molten metal. However, the finely divided solid metal and molten metal react to form a solid phase within the molten metal. Most advantageously, the metals react to form an intermetallic phase. The bath of molten metal is mixed to distribute the solid phase throughout the molten metal. For purposes of this specification, the process step of mixing is defined as any process for increasing uniformity of solid phase distribution within the molten metal. The mixture is then cast to produce a solid object. The cast solid phase has a size profile related to the initial size of the finely divided metal. For example, smaller particles may be used to seed smaller solid phase sizes. Furthermore, the solid phase is insoluble in the matrix of the solid object to provide excellent phase stability.

Advantageously, the insoluble phase particles have an average particle size of less than about 100 microns. Limiting particle size to about 50 microns further increases strength of the alloy. Most advantageously, particle size is limited to about 20 microns for improved strength. Most advantageously, particle size of the insoluble particles range from about 1 to 20 microns for optimal material performance.

In addition, the solid metal may preferably react with a component of the molten metal alloy such that the liquid composition changes. By an appropriate selection of starting alloy and desired volume fraction of the finely divided solid phases, the thermal properties of the mush alloy may be specifically tailored to varied processing requirements.

The following examples were prepared with reference to the binary Zn—Al and Zn—Ni diagrams (M. Hansen, *Der Aufbau der Zweistofflegierungen,* (1936) pp. 162–68 and 963–69) as well as the Zn-rich end of the Zn—Al—Ni ternary diagram (Raynor et al, "Ternary Alloys Formed By Aluminum, Transitional Metals and Divalent Metal," *ACTA METALLURGICA,* Vol. 1, (November 1953), pp. 637–38).

EXAMPLE 1

Pure nickel powder with a size range of 3 to 7 microns (INCO Limited 123) was added to pure zinc held at 500° to 600° C. Additions of nickel were made from 2 to 5 wt % with the sigma phase ($Ni_3Zn_{22}$) anticipated to form above 2.4 wt % Ni according to the Ni—Zn binary phase diagram. Mixtures were stirred for 30 seconds and cast in a graphite mould. The microstructures of the samples contained a fine precipitation of the sigma phase in a matrix of pure zinc (FIG. 1). Average particle size of the second phase was less than 20 microns.

A similar experiment performed with coarse nickel powder (+75 μm) residing in large particles consisting of an unreacted core of pure nickel approximately 75 μm in diameter with the sigma phase distributed around these particles in a "sunburst pattern" and within the zinc phase.

EXAMPLE 2

Figure 2:
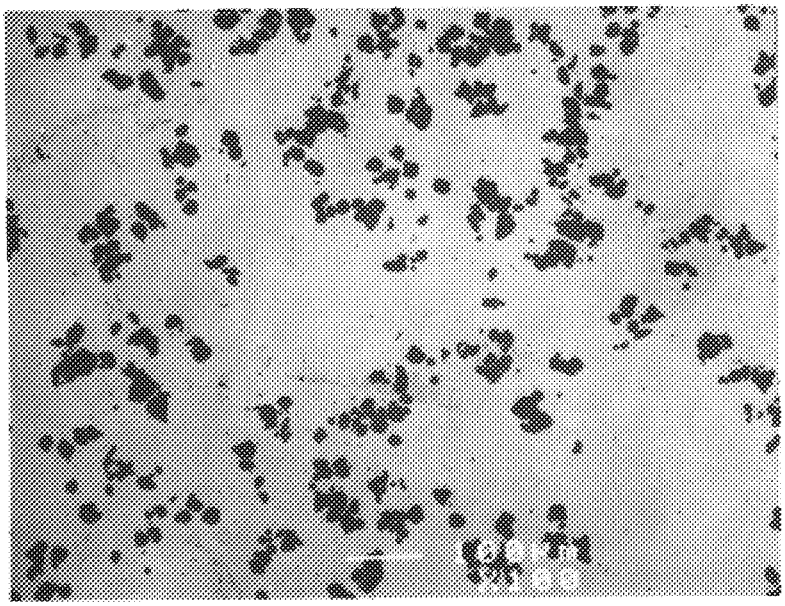
FIG. 2 is a photomicrograph (at a magnification of approximately 100×) of zinc alloy No. 3 with 5.5% nickel 123 powder cast after a 24 h holding period.

Nickel 123 powder (1 to 7 wt %) was added to zinc die casting alloy No. 3 (UNS Z33520 3.5–4.3 Al, 0.02–0.05 Mg, 0.004 max. Cd., 0.25 max. Cu, 0.100 max. Fe, 0.005 max. Pb, 0.003 max. Sn and balance Zn) at 550° C. Cooling curves were generated which confirmed that aluminum was progressively removed from solution as $Al_2Ni_3$ leaving a liquid richer in zinc. The freezing point of the mush alloy increased in temperature with increasing nickel content making the alloy unsuitable for hot chamber die casting. The average particle size of the aluminide phase was 20 to 30 microns and was found to be stable on freezing and remelting of the mush (FIG. 2).

Similar experiments were performed with nickel added as shot (5 to 10 mm pellets). The nickel took several hours to react with the zinc alloy melt at 550° C. and the resulting aluminide phase was typically 50 to 75 μm in diameter.

EXAMPLE 3

Figure 3:
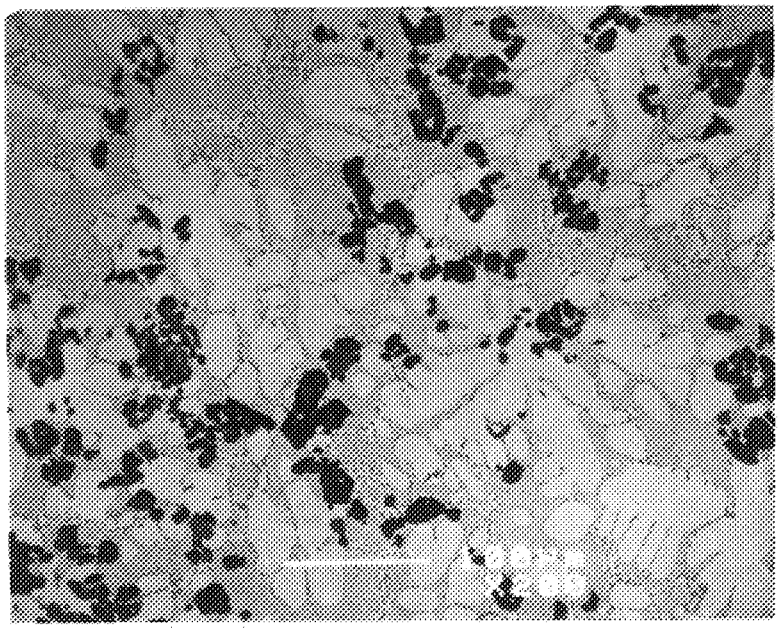
FIG. 3 is a photomicrograph (at a magnification of approximately 200×) of zinc alloy ZA-8 with 5.5% nickel 123 powder cast after a 48 h holding period.

Approximately 5.5 wt % Ni 123 powder was added to zinc alloy ZA-8 (UNS Z35636) at 550° C. Once the nickel powder had been incorporated into the melt forming a mush, the temperature was lowered to 450° C. and stirred for several hours. The equilibrium composition of the matrix phase corresponded approximately to aluminum alloy No. 3 (primary zinc+eutectic) alloy and a dispersion of Ni bearing intermetallics with $Ni_2Al_3$ and $NiAl_3$ stoichiometry. Some substitution of zinc for nickel was noted (average 1.5 wt %). The average particle size of the aluminide phase was 10 to 30 μm which was stable after freezing and remelting over a period of 48 hours (FIG. 3).

The above experiment was repeated with nickel shot similar to the example above. Particles were typically present as clusters of $Ni_2Al_3$ particles surrounded by $NiAl_3$ particles and ranged in sized from 10 to 50 μm.

Microhardness measurements were made on the above phases. Vicker's microhardness of the aluminide phases was approximately 480 Hv and 820 Hv for the $Al_2Ni_3$ and $AlNi_3$ phases respectively. These values favorably compare to a primary zinc hardness of 70 to 80 Hv and eutectic microhardness of 80 to 100 Hv.

EXAMPLE 4

Figure 4:
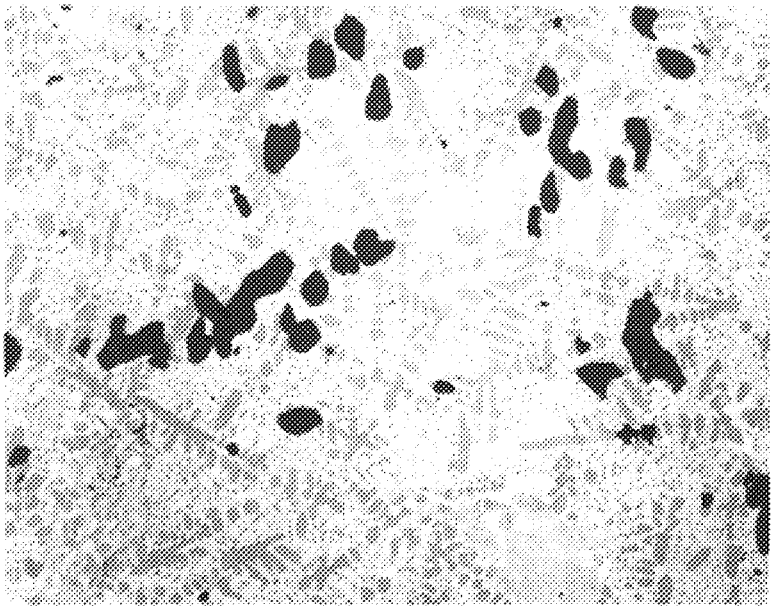
FIG. 4 is a photomicrograph (at a magnification of approximately 500×) of zinc alloy ZA-12 with 5.5% nickel 123 after 24 h at 450° C.

Approximately 5.5 wt % of Nickel 123 powder was added to zinc alloy ZA-12 (UNS Z35631 10.5–11.5 Al, 0.5–1.25 Cu, 0.015–0.030 Mg, 0.004 max. Cd, 0.06 max. Fe, 0.005 max. Pb, 0.003 max. Sn and balance Zn) at 550° C. The temperature was reduced to 450° C. and the mush was stirred for several hours. The mush was solidified and remelted and a sample cast in a graphite mould. The microstructure consisted of a matrix of approximately ZA-8 composition (primary Zn—Al+eutectic) and particles of NiAl that averaged 10 to 20 μm in diameter (FIG. 4). The freezing point of the mush was approximately 383° C. which is close to that of ZA-8 alloy and therefore suitable for hot chamber die casting.

This alloy was subsequently cast in the form of flat and round tensile bars using a cold chamber die casting machine. Results of ¼" round tensile tests at room temperature indicated that both the strength and elongation of the nickel-reinforced material was inferior to that of similarly cast ZA-8 alloy (310 MPa, 0.8% vs. 380 MPa, 4% respectively). Results were much closer for an elevated temperature test at 120° C. (170 MPa, 5.5% vs. 180 MPa, 30% respectively).

Figure 5:
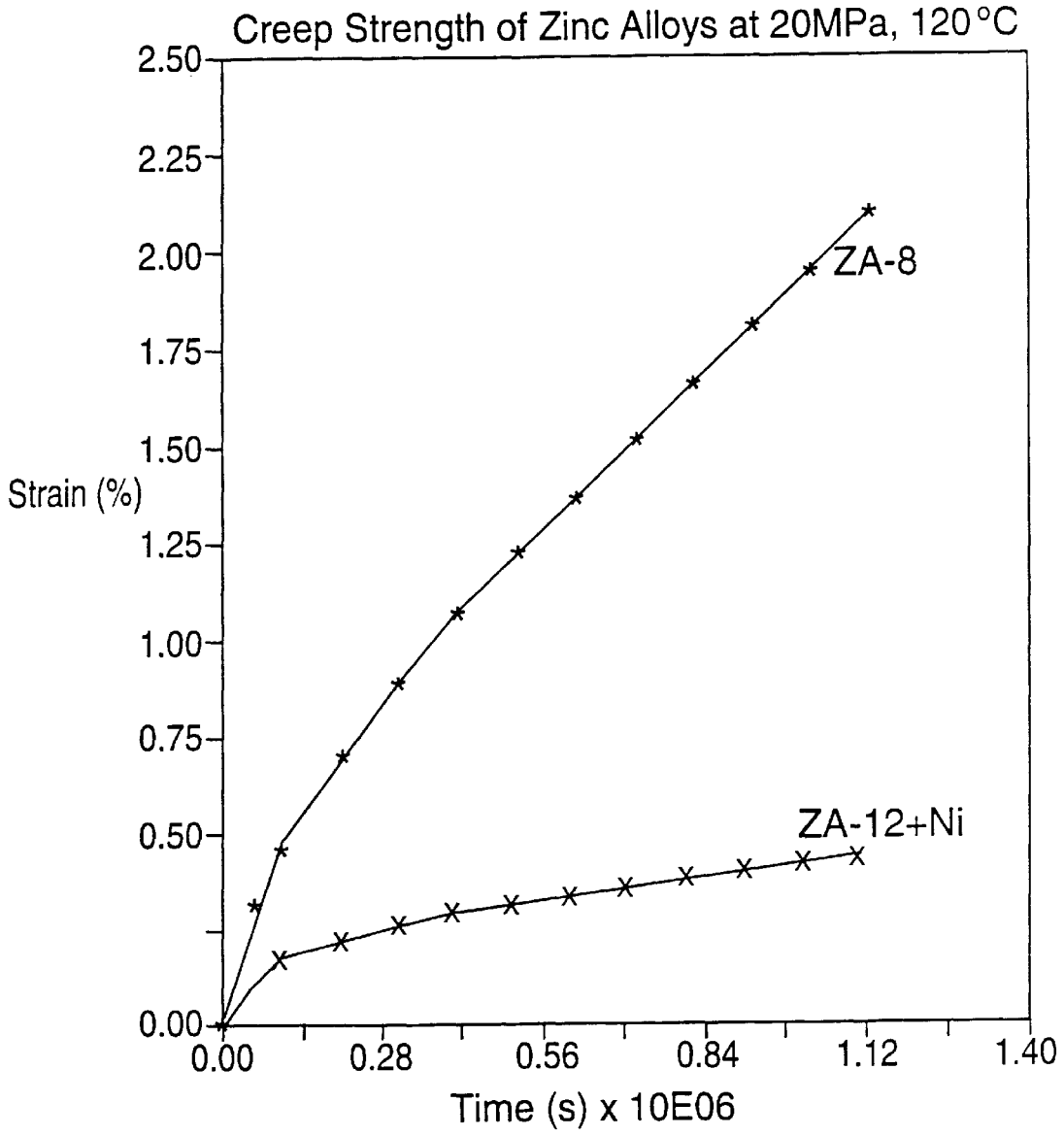
FIG. 5 is a graph of strain vs. time for ZA-12 alloy with 5.5% Ni at 120° C. and a load of 20 MPa.

The reduced elongation of the nickel-reinforced alloy indicated a possible improvement in creep resistance over the ZA-8 alloy at 120° C. The flat tensile bars were tested for creep strength at a constant load of 20 MPa or 30 MPa and a constant temperature of 120° C. The results compared favorably with ZA-8 alloy which is the zinc-aluminum die casting alloy possessing the highest creep strength (FIG. 5). The results at 20 MPa indicated that a five-fold improvement in creep rate was obtained for the nickel-containing mush alloy over the ZA-8 alloy.

It is expected that higher volume fractions of reinforcing phase would lead to further improvements in creep strength. The amount to of nickel added to ZA-12 alloy in this example was 5.5 wt % to arrive at an as cast matrix of near ZA-8 composition. Assuming that all of the nickel was consumed as $NiAl_3$, the volume fraction of the resulting intermetallic phase was approximately 12 vol. %. A significant improvement in creep resistance has therefore been obtained at a lower loadings of reinforcing phase than with the $TiB_2$ of Tang et al, previously noted.

EXAMPLE 5

Figure 6:
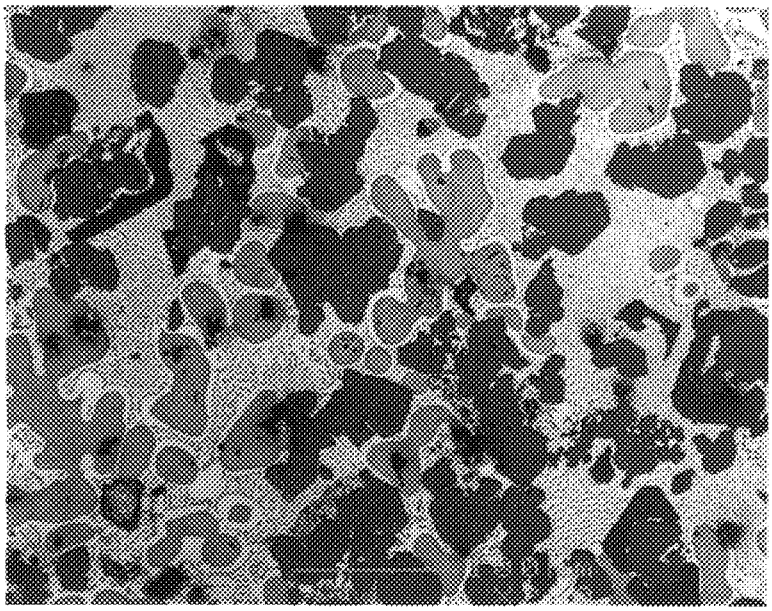
FIG. 6 is a photomicrograph (at a magnification of approximately 200×) of zinc alloy ZA-27 with 12 wt % Ni cast at 550° C. after 48 h.

Approximately 12 wt % of Nickel 123 powder was gradually added to zinc alloy ZA-27 (UNS Z35841) at 550° C. The mixture was constantly stirred, however the high volume fraction of aluminide phases formed (>30 vol %) rendered efficient mixing difficult. It was found that the temperature could not be reduced as per the previous two examples without freezing. The microstructure revealed a matrix of near ZA-8 composition with two intermetallic reinforcing phases (FIG. 6). The average particle size was on the order of 75 μm after melting and freezing as per the previous examples. These phases were analyzed by SEM and were found to be of $NiAl_3$ and $Ni_2Al_3$ stoichiometry, however copper was observed at concentrations up to 10 at % in the "$Ni_2Al_3$" phase. Since copper contributes to the strength of the matrix and plays an important role in blocking creep mechanisms, its removal from solution in the matrix provided a deleterious effect.

EXAMPLE 6

This Example illustrates the expected results for magnesium-aluminum-nickel alloys produced with the nickel powder mush casting process of the invention. An AZ91 alloy containing, by weight percent, 9% Al, 0.7% Zn, 0.2% Mn and balance magnesium is initially melted. An additional 4 wt % nickel 123 powder is slowly mixed into the alloy with stirring. Extra aluminum in an atomic ratio of 3 atoms aluminum to 1 atom nickel is then added to the melt. The aluminum then reacts with the nickel to form a stable mush of molten AZ91 alloy and solid $Al_3Ni$ particulate. The mush alloy is then cast to produce a solid AZ91 matrix containing $Al_3Ni$ particulate. The $Al_3Ni$ particulate is insoluble in the matrix and is believed to greatly increase the elevated temperature creep resistance of the alloy.

These examples show that a stable mush alloy can be produced by adding fine nickel powder to magnesium, magnesium-base alloys, zinc and zinc-base alloys. Alternatively, the method of the invention is expected to operate for aluminum or aluminum-base alloys with finely divided nickel particulate. Most advantageously, the process of the invention is used for magnesium-base or zinc-base alloys. However, the method of the invention is particularly effective for zinc-aluminum-nickel alloys that may not be produced by conventional alloying techniques. Conventional alloying techniques are not effective for alloying zinc-aluminum alloys with nickel, since zinc-aluminum alloys vaporize below the melting temperature of nickel. Preferably, the addition of nickel is determined such that the resulting matrix phase and hence the freezing point of the alloy falls within the range that can be hot chamber die cast. For the zinc-aluminum alloy system, the above examples have demonstrated that a final liquid composition on either side of the eutectic can be produced, namely a near ZA-8 or No. 3 alloy composition. Additionally, a near eutectic matrix compositions would likely possess superior properties by reducing the volume of primary phase. For die casting applications, this invention can be extended to alloy compositions having freezing points below, up to or even above that of pure zinc (420° C.). Advantageously, the molten metal has a melting temperature below 480° C. to allow die casting with cast iron components. Most advantageously, the alloy will freeze below 400° C. to allow suitable superheat for casting purposes.

The examples have also demonstrated that the particle size of the reinforcing intermetallic phase was related to the size of the fine solid powder addition. Particulate having a size of less than 75 microns in at least one direction is advantageously used to control the size of the solid phase produced. For best results, average particulate size of less than 10 microns is used. The finest nickel powder addition (3 to 7 μm) gave an intermetallic particle size range of about 10 to 20 μm under the best mixing conditions. The best mechanical properties of the mush alloy were obtained with the finest microstructure. However, alloys made with approximately 1 μm nickel particulate had a tendency to agglomerate. Growth of the particles was limited to the first hour of mixing, after which time the mush was stable during prolonged holding times (>48 h) and after freezing and remelting operations. Advantageously, the nickel particulate has a size of about 1 to 75 μm.

Advantageously, a range selected from about the ranges of Table 1 below is used for zinc-base alloys.

| | BROAD | INTERMEDIATE | NARROW |
|---|---|---|---|
| Aluminum | 3 to 40 | 6 to 35 | 8 to 30 |
| Nickel | 0.8 to 25 | 2 to 20 | 3 to 15 |
| Copper | 0 to 12 | 0 to 8 | 0.5 to 6 |
| Magnesium | | 0 to 0.2 | 0 to 0.1 |
| Iron | | | 0 to 0.2 |
| Lead | | | 0 to 0.1 |
| Cadmium | | | 0 to 0.1 |
| Tin | | | 0 to 0.1 |
| Zinc | Balance + Incidental Impurities | Balance + Incidental Impurities | Balance + Incidental Impurities |

Aluminum serves to lower the melting point of the alloy and increase creep resistance. A minimum of at least about 3 wt % nickel is advantageously used for creep resistance.

An addition of at least about 6 wt % aluminum or most advantageously, about 8 wt % aluminum decreases melting point below 420° C. and provides an effective increase in creep resistance. (Zinc-aluminum alloys vaporize at temperatures below the melting point of nickel.) An addition of as high as about 40 wt % aluminum is possible when a high concentration of aluminide intermetallics are desired. Aluminum is advantageously limited to about 35 wt % and most advantageously limited to about 30 wt % to prevent an unacceptable loss of ductility.

Nickel is deliberately added to form insoluble nickel aluminides. At least about 0.8 wt % nickel is required to significantly increase creep resistance. Advantageously, at least about 1 wt % and most advantageously at least about 2 wt % nickel is added to improve elevated temperature creep resistance. As high as about 25 wt % nickel may be added to form a stiff, creep resistant alloy. Advantageously, the alloy is limited to about 20 wt % nickel and most advantageously, about 15 wt % nickel for maintaining ductility at room temperature. An addition of at least 3.5 wt % nickel has been found to be particularly effective at increasing creep resistance at elevated temperatures.

As high as about 12 wt % copper is optionally added for matrix strength and creep resistance. Advantageously, copper is limited to about 8 wt % and most advantageously, about 6 wt % to maintain ductility. Most advantageously, about 0.5 wt % copper is added for increased strength and creep resistance.

Magnesium may be added to as high as about 0.2 wt % for increased strength. For example, an addition of at least about 0.001 wt % magnesium will contribute to increased strength of the alloy. Most advantageously, magnesium is limited to about 0.1 wt % to prevent excess ductility loss.

Iron is most advantageously limited to about 0.2 wt % to limit step losses. Finally, lead, cadmium and tin are each advantageously limited to about 0.1 wt % to prevent intragranular corrosion losses.

When using a zinc-nickel system, the nickel reacts with the zinc to form $Ni_3Zn_{22}$ phase. For zinc-aluminum-nickel alloys, two basic stoichiometries of intermetallic phases were observed to have formed. For hypoeutectic alloys, $Ni_2Al_3$ was exclusively found to occur which corresponds well to the known region (Zinc rich end) of the ternary Zn—Al—Ni diagram. The greatest yield of reinforcing phase as a function of nickel addition occurred with the formation of $NiAl_3$ in the hypereutectic alloys. The $Ni_2Al_3$ phase was found to occur at high nickel additions in the ZA-27 alloy. In addition, a relatively small percentage of ternary Zn—Al—Ni phases may also be formed. The formation of this phase also removed copper from solution in primary Zn—Al. Therefore, most advantageously the formation of $NiAl_3$ is preferred thereby limiting the maximum amount of nickel powder that can be added and as a consequence the volume fraction of the reinforcing phase. This limit was found to lie between the about 5.5 wt % Ni added to ZA-9 alloy and about 12 wt % added to alloy ZA-27. When nickel aluminides are formed, it is important to stir the melt to maintain distribution of the nickel aluminides.

Magnesium-base systems are believed to be directly analogous to zinc-base systems. Most advantageously a magnesium-aluminum alloy is used in combination with nickel particulate. The nickel particulate readily reacts with molten aluminum to form a nickel aluminide-containing mush. Advantageously, the nickel aluminum alloy contains about 3 to 43% aluminum and 2 to 10% nickel.

As will be appreciated by one skilled in the art, other materials such as graphite, chopped carbon fibers, chopped coated glass fibre, and ceramic particles can be advantageously added to this stable mush prior to casting. The stable solid-liquid mush prevents lighter particles from rising and facilitates uniform distribution of materials added to the mush. It is also advantageous to use nickel coated particulate solids such as graphite, chopped carbon fibers, chopped glass fibers and ceramic particles prior to addition to the melt to promote rapid wetting of the solids and incorporation in to the melt as described by Badia et al in U.S. Pat. No. 3,753,694.

In addition to Mg—Ni, Zn—Ni, Mg—Al—Ni and Zn—Al—Ni, alloy systems in which the process of the invention are believed to operate effectively include Zn—Cu and Zn—Fe alloys as well as related ternary and multiple alloy systems.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An alloy consisting essentially of, by weight percent, about 3 to 40 aluminum, about 0.8 to 25 nickel, about 0 to 12 copper and balance zinc and essential impurities, and said alloy having a zinc-containing matrix with nickel aluminides distributed throughout said zinc-containing matrix said nickel aluminides being formed from reacting said aluminum with insoluble nickel powder having an average size of about 1 to 75 $\mu$m.

2. The alloy of claim 1 wherein said nickel aluminides have an average size less than about 100 microns.

3. The alloy of claim 1 wherein said alloy contains about 6 to 35 aluminum, about 2 to 20 nickel, about 0 to 8 copper and about 0 to 0.2 magnesium.

4. The alloy of claim 3 wherein average size of said nickel aluminides is less than about 50 microns.

5. The alloy of claim 1 wherein said alloy contains about 8 to 30 aluminum, about 3 to 15 nickel, about 0.5 to 6 copper and about 0 to 0.1 magnesium.

6. The alloy of claim 5 wherein said alloy contains about 0 to 0.2 iron, about 0 to 0.1 lead, about 0 to 0.1 cadmium and about 0 to 0.1 tin.

7. The alloy of claim 6 wherein average size of said nickel aluminides is about 1 to 20 microns.

* * * * *